United States Patent [19]

Henline

[11] Patent Number: 4,724,971

[45] Date of Patent: Feb. 16, 1988

[54] WRAP-AROUND HANDLE FOR BOTTLES

[76] Inventor: Jerry W. Henline, 6507 Woody La., Goshen, Ohio 45122

[21] Appl. No.: 817,888

[22] Filed: Jan. 13, 1986

[51] Int. Cl.[4] ..... B65D 23/12

[52] U.S. Cl. ..... 215/100 A; 220/94 R; 294/27.1; 16/110.5

[58] Field of Search ..... 16/110.5; 294/27.1, 294/31.2; 220/85 H, 94 R; 206/148, 168; 215/100 A, 100 R

[56] References Cited

U.S. PATENT DOCUMENTS

| | | | |
|---|---|---|---|
| D. 149,933 | 6/1948 | Bushman | 215/100 A |
| 1,702,555 | 2/1929 | Watson | 294/27.1 |
| 2,227,780 | 1/1941 | Hickman et al. | 294/27.1 |
| 2,308,744 | 1/1943 | Buys | 215/100 A |
| 2,617,676 | 11/1952 | Kinney, Jr. | 294/31.2 |
| 3,021,026 | 2/1962 | Clare | 294/27.1 |
| 3,116,947 | 1/1964 | Brownrigg | 294/31.2 |
| 3,202,309 | 8/1965 | Simpson | 215/100 A |
| 3,463,536 | 8/1969 | Updegraff et al. | 294/31.2 |
| 4,090,729 | 5/1978 | Erickson | 294/31.2 |
| 4,379,578 | 4/1983 | Schuler | 294/31.2 |
| 4,456,135 | 6/1984 | Beekes | 294/27.1 X |
| 4,552,396 | 11/1985 | Rais | 294/27.1 |
| 4,582,215 | 4/1986 | Barrash | 294/31.2 X |

*Primary Examiner*—Paul A. Bell
*Assistant Examiner*—James L. Wolfe
*Attorney, Agent, or Firm*—Charles R. Wilson

[57] ABSTRACT

A handle for use with a bottle of the type having a flange extending circumferentially around the neck of the bottle typically used, but not limited to, for the marketing of soft drink beverages. The handle comprises three distinct integral portions, a first ring-shaped holdeer slips over and around the body of the bottle, a second ring-shaped holder fits over the flange of the bottle when properly positioned and will be secured to the bottom surface of the flange, and the gripping portion extending from the first to the second ring-shaped holder. The gripping portion forms an arc for easy grasping due to the pressure that occurs on the resilient substrate from the engagement of both rings and is integral with each ring.

17 Claims, 7 Drawing Figures

WRAP-AROUND HANDLE FOR BOTTLES

This invention relates to handles to be used with bottles. More specifically, the invention relates to handles useful for handling bottles of the type which are made of plastic with a flanged neck and typically used for the marketing of soft drink beverages.

BACKGROUND OF INVENTION

The marketing of soft drink beverages in 2 liter plastic bottles has been steadily increasing over the last decade. The industry has now expanded to include 3 liter plastic bottles similar in nature, and someday may include even larger bottles. Though these types of bottles permit a cost effective means for bottling soft drink beverages, they have drawbacks to the consumer handling them.

One article has been suggested as useful for solving many of the problems encountered in handling the aforementioned bottles. As pointed out in U.S. Pat. No. 4,456,135, the weight of the bottle, when full, makes it difficult to grasp. With the introduction of 3 and 4 liter bottles it makes it even more difficult to grasp around its body. The thin wall of the bottle permits it to collapse when the cap is off and pressure applied around the body during a normal pouring process. It is nearly impossible to grasp, lift, and pour such bottles without using both hands, one around the neck and one at the bottom.

Even though the aforementioned U.S. patent has addressed the problems inherent with 2 liter bottles, the detailed and intricate design of the described article is relatively expensive to manufacture and thus does not provide the easiest solution to the problem. There is a need for a handle simple in design and inexpensive in cost which can be used for the handling of bottles. In accord with this invention, such a handle has been invented.

SUMMARY OF THE INVENTION

The handle of this invention is made of a unitary resilient material having three distinct integral portions to facilitate grasping, lifting, carrying and pouring of a bottle typically made of plastic and having a flange around its neck. The handle comprises (a) a first ring-shaped holding means dimensioned to pass over the cylindrically shaped body of the bottle, and to frictionally engage said body when an upwardly directed angular force is exerted on the holding means, (b) a second ring-shaped holding means having an inside configuration such that it will fit over the flange of the bottle when properly positioned with the plane of the flange but unable to pass over said flange once positioned underneath the flange and an upwardly directed force is exerted on the holding means; and (c) a grip means extending from the first ring-shaped holding means to the second ring-shaped holding means, said grip means having a sufficient length to bend when said two holding means are separately engaged with the bottle and thereby form a shape for easy handling.

The novelty of this invention and an appreciation of its simple design and advantages will be more fully understood from the following description of the preferred embodiment and referenced drawings. It is to be expressly understood, however, that the drawings are for the purpose of illustration and description only and are not intended as a definition of the limits of the invention.

DESCRIPTION OF THE INVENTION

Figure 1:
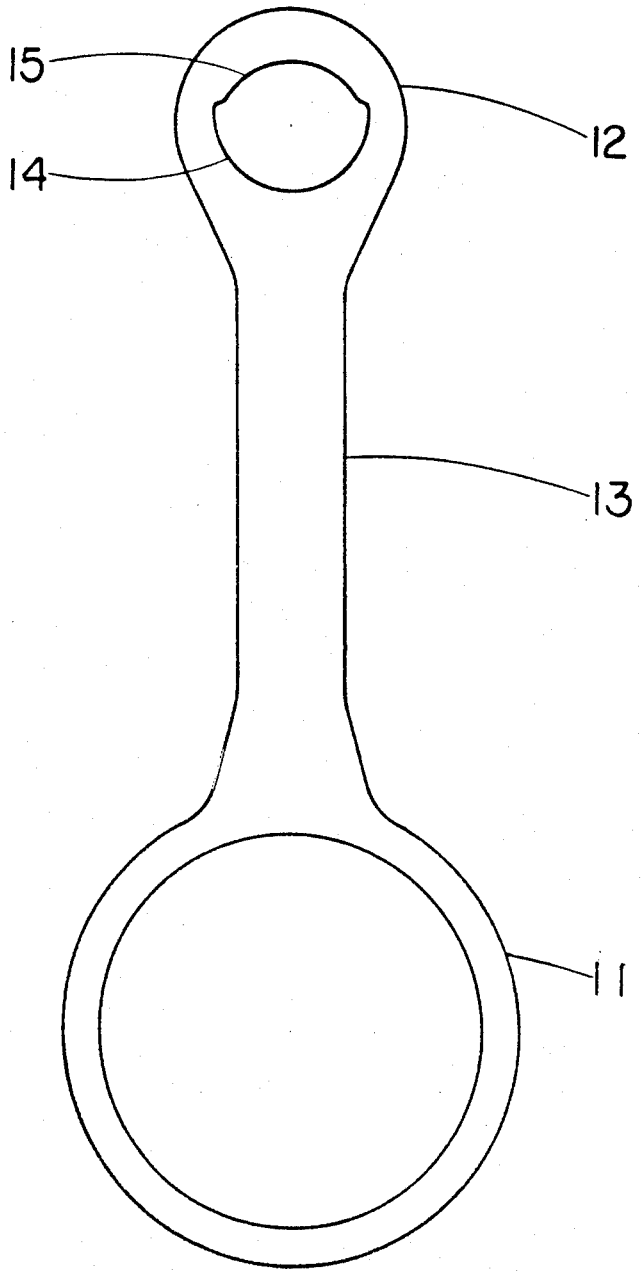
FIG. 1 is a front view of a handle of the present invention.
Figure 2:
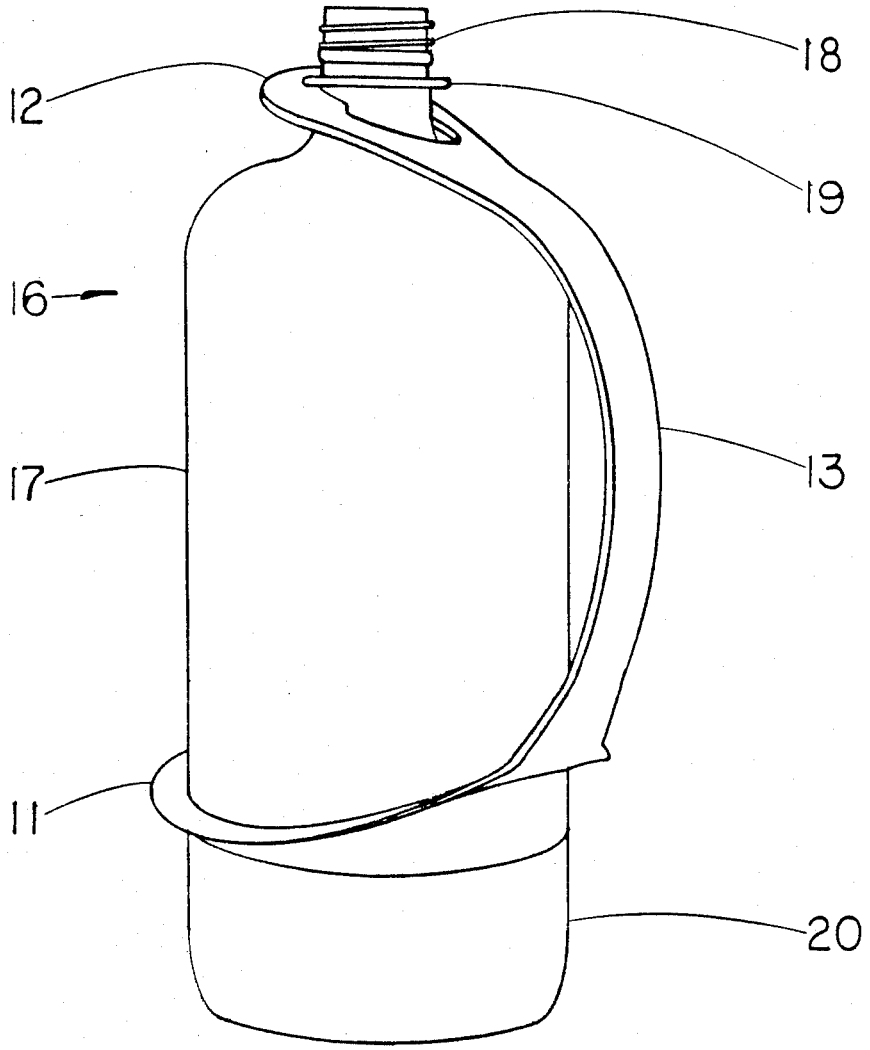
FIG. 2 is a view in perspective showing the handle of FIG. 1 properly positioned on a bottle.

With reference to the drawings, it will be noted that FIG. 1 illustrates a preferred embodiment of the invention, and FIG. 2 illustrates the use of the article illustrated in FIG. 1.

As shown in FIG.1, the handle of this invention comprises a first ring-shaped holding means 11, a second ring-shaped holding means 12, and a grip means 13 extending from holding means 11 to holding means 12. The first ring-shaped holding means 11 is dimensioned to slidably pass over a cylindrically shaped body such as found with conventional two liter and larger bottles. Generally, the inside diameter of the ring-shaped holding means ranges from about three inches to about six inches, though the exact dimension is dictated by the bottle size; the need for the handle primarily exists only for larger bottles that can not be readily handled with ordinary human effort. The inside diameter of ring-shaped holding means 11 must also be dimensioned such that it will frictionally engage the bottle's body when an upwardly directed angular force is exerted on the holding means.

The second ring-shaped holding means 12 has an inside configuration such that it will fit over a flange found on the bottle's neck when properly positioned with the plane of the flange, but will be unable to pass back over said flange once positioned underneath the flange and an upwardly directed force is exerted on the holding means. Several different configurations are capable of fulfilling this function. All are within the scope of this invention. As shown in FIG. 1, holding means 12 has a generally curvilinear inside configuration wherein a (1) major cross dimension is greater than the flange's diameter and (2) a minor cross dimension is greater than the distance from an outside edge of the flange to a diametrically opposite inside edge of the flange but less than the flange's diameter. The substantially semi-circular shape 14 having the major cross dimension is primarily responsible for allowing the holding means 12 to pass over the bottle's flange when properly aligned; the second substantially semi-circular shape 15, contiguous with the first semi-circular 14, is responsible for the holding means 12 being constrained by the flange when not aligned.

Grip means 13 extends from the first ring-shaped holding means 11 to the second ring-shaped holding means 12. The function of grip means 13 is to act as a grasping means for the human hand to hold to manipulate the handle and bottle being held by the handle. The length of grip means 13 is such that when the handle is properly installed on a bottle, the human hand can readily grasp the grip means. At the same time, the length of the grip means 13 can not be so great as to permit the second ring-shaped holding means 12 to assume a position which allows it to pass back over the bottle's flange. Generally, the grip means' length ranges from about six inches to about nine inches, depending on the length of the bottle over which the handle of this invention is intended to be used. The grip means is in the form of a narrow shaped arm.

The handle is a unitary structure made from a material which is resilient. Grip 13 means also must be flexible enough to bend while the handle is being installed onto a bottle as more fully discussed below. The grip means during use causes the two holding means to properly engage the body and flange of a bottle. The material is resilient so that once properly positioned on the bottle, it will try to return to its natural state. However, because of its configuration it will instead frictionally engage the body and assume a position which does not allow it to pass over the flange. Many materials can be used for making the handle. Preferred are the polymeric materials such as the polyethylenes, polypropylenes, polybutylenes, polycarbonates, polystyrenes, polyurethanes, polyvinylchlorides, polyesters, acrylics and copolymers derived from any of the monomers from which any of the aforementioned polymers are made. A polyethylene, especially a high density polyethylene, is preferred due to its cost and ability to be molded.

FIG. 2 shows the handle of the present invention affixed in place on a bottle 16. The bottle 16 includes a cylindrically shaped body 17, a neck 18, and a flange 19 which extends around the neck 18. An optional guard 20 is positioned over the bottom surface of the bottle to provide a flat bottom surface and add strength to the bottle. To establish the handle on the bottle, the first ring-shaped holding means 11 is slipped over the top of the bottle and positioned midway down the sides of the bottle. While forcing the entire handle in a bowed position, the second ring-shaped holding means 12 is positioned appropriately over the flange of the bottle. It should be noted that due to the configuration of the inside of the second holding means 12, it will only fit over the flange when in a specific position in relation to the flange. Once over the flange the resilience of the substrate when pressure is released will not permit the second holding means 12 to slip back over the flange unless it is intentionally forced back into the necessary position to do so. The interference of the second holding means with the bottom surface of the flange secures said holding means around the neck of the bottle while retaining pressure on the resilient substrate to form the bowed shape which acts as the grip of the handle.

Figure 3:
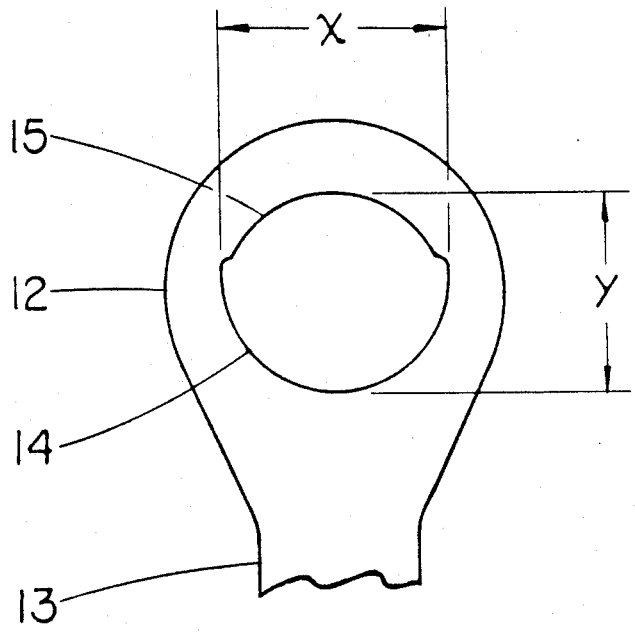
FIG. 3 is a detailed front view of a part of the handle shown in FIG. 1.
Figure 4:
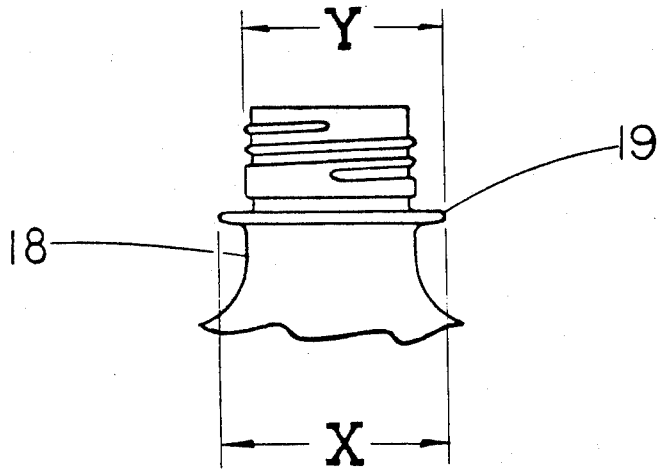
FIG. 4 is a view in detail showing the neck and flange of the bottle of FIG. 2.

FIGS. 3 and 4 illustrate, in more detail, the dimensions of the second ring-shaped holding means 12 of FIG. 1. As shown in FIG. 3, the inside configuration of holding means 12 has a major cross dimension of x and a minor cross dimension of y, each extending through a center point. Cross dimension x is greater than the distance of X as shown in FIG. 4, representing the flange's diameter. Cross dimension y is (1) greater than the distance Y as shown in FIG. 4, representing the distance from an outside edge of the flange to a diametrically opposite inside edge of the flange and (2) less than the flange's diameter X. The major cross dimension x is thus large enough to allow the holding means 12 to slip over flange 19; the minor cross dimension y is small enough that once the holding means 12 is positioned underneath flange 19 and an upwardly directed force exerted through grip means 13, said holding means is retained by flange 19.

Figure 5:
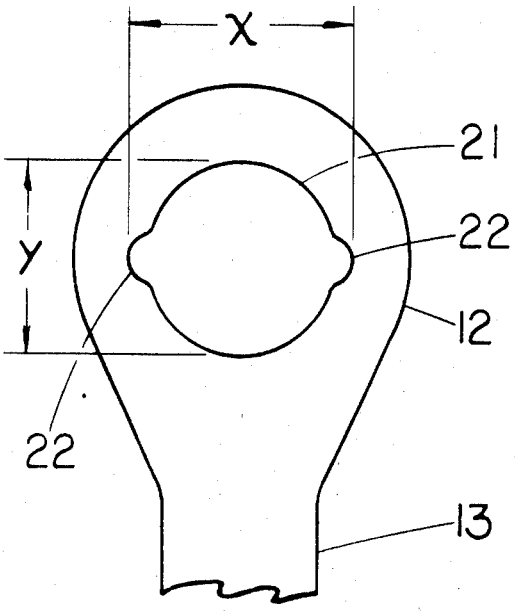
FIG. 5 is a partial front view of another handle of the present invention having a holding means with a generally curvilinear inside configuration.

FIG. 5 is a section of a handle showing another inside configuration of the second holding means 12. The inside of the ring is a generally curvilinear configuration comprised of a circle 21 with two cut-outs 22, contiguous with the circle and opposite one another. The dimension x represents the major cross dimension. The exact dimensions of x and y are based on the flange's dimensions as discussed above.

Figure 6:
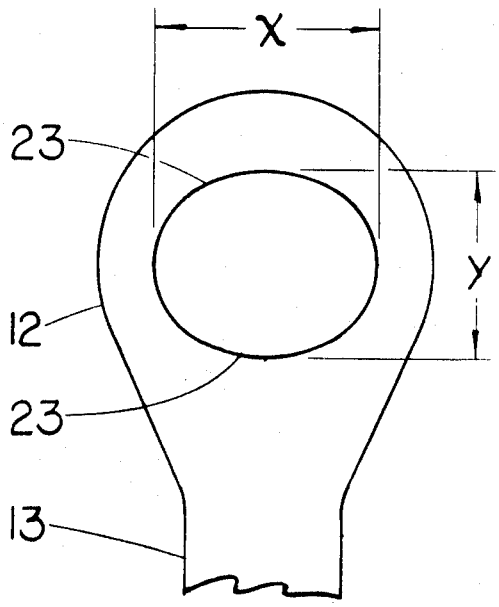
FIG. 6 is a partial front view of still another handle having a holding means with a generally curvilinear inside configuration.

FIG. 6 represents another holding means 12 having an inside configuration of a generally curvilinear shape comprised of arcs 23. Dimension x represents the major cross dimension and y the minor cross dimension.

Figure 7:
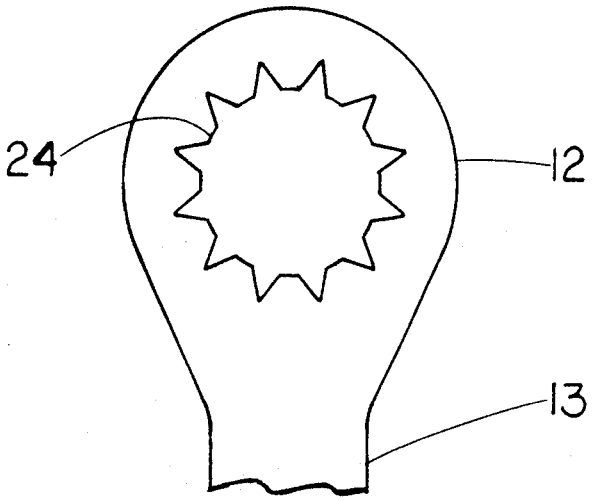
FIG. 7 is a partial view of another handle of the invention wherein the holding means' inside configuration has a series of protrusions.
Figure 5:
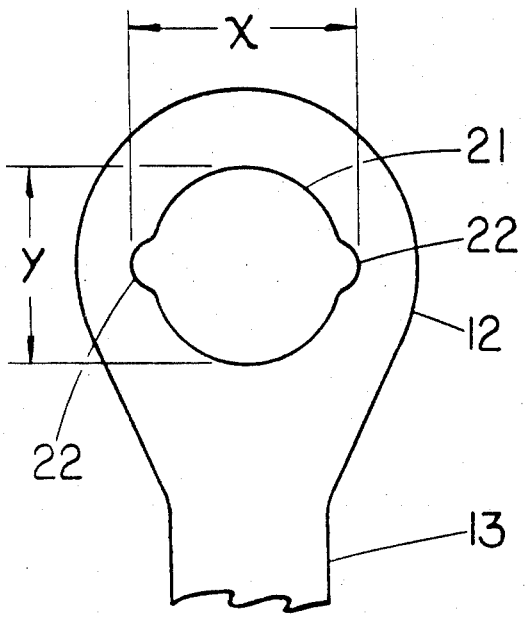
Figure 6:
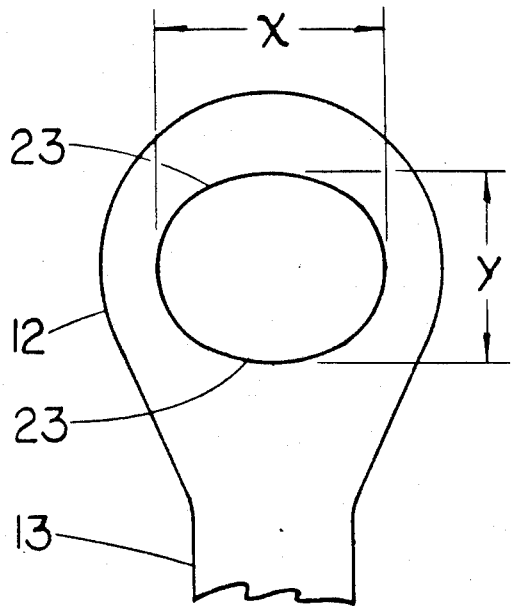
Figure 7:
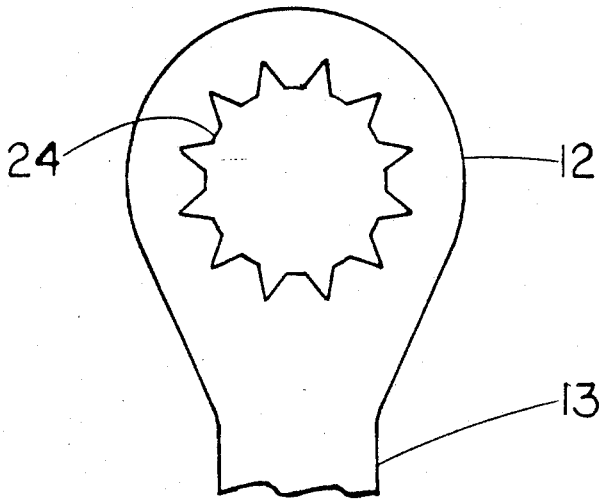

FIG. 7 illustrates another embodiment of the invention. The second ring-shaped holding means 12 has an inside configuration comprised of a series of protrusions 24 extending inwardly from the inner periphery of the ring. The resilient and flexible nature of the material from which the handle is made allows the protrusions 24 to bend when forced over a flange of a bottle. However, once properly positioned, the protrusions 24 will not pass back over said flange when a force is exerted on the grip means 13 as is normally encountered when the handle is used.

The handle of this invention can be easily installed and removed at will and can be reused over and over again. Because the handle of this invention is made of a single, flat piece of substrate, the manufacturing cost is minimum and can be used as a promotional item, while being conducive to concise packaging and handling methods.

Thus, there has been described a handle to manipulate a commonly used type of bottle and the preferred embodiment has been illustrated. The simplicity in the design of said handle is not to be interpreted as a limitation to other preferred embodiments that may be obvious to persons skilled in the art. The embodiment described herein together with those additional embodiments are considered to be within the scope of the invention.

What is claimed is:

1. A handle having a unitary structure and made from a resilient material, said handle useful for the handling of bottles when in the upright position wherein the bottles have a cylindrically shaped body and a neck extending from the body with a flange encircling the neck, said handle comprised of:

(a) a first ring-shaped holding means having an inside configuration dimensioned to slidably pass over the cylindrically shaped body of the bottle, and to frictionally engage said body in the upright position when an upwardly directed angular force is exerted on the holding means;

(b) a second ring-shaped holding means having an inside configuration different from that of the first ring-shaped holding means, said configuration being generally curvilinear and having (1) a major cross dimension greater than said flange's diameter and (2) a minor cross dimension greater than the distance from an outside edge of the flange to a diametrically opposite inside edge of the flange but less than the flange's diameter such that the holding means will fit over the flange of the bottle when properly positioned with the plane of the flange but unable to pass over said flange in the upright position once positioned underneath the flange and an upwardly directed force is exerted on the holding means; and (c) a grip means extending from the first ring-shaped holding means to the second ring-shaped holding means, said grip means having a sufficient length to bend when said two holding means are separately engaged with the bottle and thereby form a shape for easy handling.

2. The handle of claim 1 wherein the inside configuration of the second ring-shaped holding means is comprised of a first substantially semi-circular form and a second substantially semi-circular form said semi-circles contiguous so as to form one opening.

3. The handle of claim 1 wherein the second ring-shaped holding means is comprised of a circle with two cut-outs contiguous with the circle and opposite one another.

4. The handle of claim 1 wherein the second ring-shaped holding means is comprised of two arcs.

5. The handle of claim 1 wherein the material from which the handle is formed is flexible.

6. The handle of claim 5 wherein the handle is formed from a polymeric material.

7. The handle of claim 6 wherein the handle is formed from polyethylene.

8. The handle of claim 1 wherein the inside diameter of the first ring-shaped holding means ranges from about three inches to about six inches.

9. The handle of claim 8 wherein the grip means has a length of from about six inches to about nine inches extending from the first ring-shaped holding means to the second ring-shaped holding means.

10. The handle of claim 9 wherein the grip means is a narrow shaped arm dimensioned to be conveniently grasped by a human hand.

11. A bottle having an attachment means for easy handling thereof when in an upright position, comprised of:

(a) a container portion having a cylindrically shaped body and a neck extending from the body through which liquid within the bottle can be poured, said neck having a flange extending around the circumference of the neck; and (b) a handle made from a resilient material, said handle frictionally engaged with the walls of the cylindrically shaped body and with the flange, and comprised of:

(1) a first ring-shaped holding means having an inside configuration dimensioned to slidably pass over the cylindrically shaped body of the bottle and to frictionally engage said body in the upright position when an upwardly directed angular force is exerted on the holding means;

(2) a second ring-shaped holding means having an inside configuration different from that of the first ring-shaped holding means, said configuration being generally curvilinear and having (1) a major cross dimension greater than said flange's diameter and (2) a minor cross dimension greater than the distance from an outside edge of the flange to a diametrically opposite inside edge of the flange but less than the flange's diameter such that the holding means will fit over the flange of the bottle when properly positioned with the plane of the flange but unable to pass over said flange in the upright position once positioned underneath the flange and an upwardly directed force is exerted on the holding means; and (3) a grip means extending from the first ring-shaped holding means to the second ring-shaped holding means, said grip means having a sufficient length to bend when said two holding means are separately engaged with the body and flange of the bottle and thereby form a shape for easy handling.

12. The bottle of claim 11 wherein the handle's inside configuration of its second ring-shaped holding means is comprised of a first substantially semi-circular form and a second substantially semi-circular form, said semi-circles contiguous so as to form one opening.

13. The bottle of claim 11 wherein the handle's second ring-shaped holding means is comprised of a circle with two cut-outs contiguous with the circle and opposite one another.

14. The bottle of claim 11 wherein the handle's second ring-shaped holding means is comprised of two arcs.

15. The bottle of claim 11 wherein the material from which the handle is formed is a flexible polymeric material.

16. The bottle of claim 15 wherein said container portion holds between about two liters to about four liters of liquid.

17. A handle having a unitary structure and made from a resilient material, said handle useful for the handling of bottles when in the upright position wherein the bottles have a cylindrically shaped body and a neck extending from the body with a flange encircling the neck, said handle comprised of:

(a) a first ring-shaped holding means having an inside configuration dimensioned to slidably pass over the cylindrically shaped body of the bottle, and to frictionally engage said body in the upright position when an upwardly directed angular force is exerted on the holding means;

(b) a second ring-shaped holding means having a generally curvilinear inside configuration comprised of two semi-circles which are contiguous to form one opening wherein the opening has a major cross dimension which is greater than the flange's diameter and has a minor cross dimension which is greater than the distance from an outside edge of the flange to a diametrically opposite inside edge of the flange but less than the flange's diameter, said major dimension for the purpose of allowing the holding means to fit over the flange of the bottle when properly positioned with the plane of the flange and said minor cross dimension responsible for the holding means being constrained by the flange once positioned underneath the flange and an upwardly directed force is exerted on the holding means; and (c) a grip means extending from the first ring-shaped holding means to the second ring-shaped holding means, said grip means having a sufficient length to bend when said two holding means are separately engaged with the bottle and thereby form a shape for easy handling.

* * * * *